US010468208B2

(12) United States Patent
Ramirez

(10) Patent No.: US 10,468,208 B2
(45) Date of Patent: Nov. 5, 2019

(54) METHOD AND ARRANGEMENT FOR ELECTRICAL SERVICE DISCONNECT

(71) Applicant: Landis+Gyr LLC, Lafayette, IN (US)

(72) Inventor: Anibal Diego Ramirez, Indianapolis, IN (US)

(73) Assignee: Landis + Gyr LLC, Lafayette, IN (US)

( * ) Notice: Subject to any disclaimer, the term of this patent is extended or adjusted under 35 U.S.C. 154(b) by 329 days.

(21) Appl. No.: 15/345,140

(22) Filed: Nov. 7, 2016

(65) Prior Publication Data

US 2018/0130618 A1 May 10, 2018

(51) Int. Cl.

| | |
|---|---|
| ***H01H 9/56*** | (2006.01) |
| ***H01H 9/30*** | (2006.01) |
| ***H01H 47/18*** | (2006.01) |

(52) U.S. Cl.

CPC ..... *H01H 9/56* (2013.01); *H01H 47/18* (2013.01); *H01H 2009/307* (2013.01)

(58) Field of Classification Search

CPC ..... H01H 9/56; H01H 47/18; H01H 2009/307
USPC ..... 361/140
See application file for complete search history.

(56) References Cited

U.S. PATENT DOCUMENTS

| | | | | |
|---|---|---|---|---|
| 5,644,463 | A * | 7/1997 | El-Sharkawi | H01H 9/56 361/2 |
| 6,906,637 | B2 | 6/2005 | Martin | |
| 7,362,232 | B2 | 4/2008 | Holle et al. | |
| 8,471,724 | B2 | 6/2013 | Morris | |
| 9,099,955 | B2 | 8/2015 | Ramirez | |
| 2006/0202858 | A1 * | 9/2006 | Holle | G01R 22/066 340/870.02 |
| 2012/0206851 | A1 * | 8/2012 | Weber | H01H 9/56 361/195 |
| 2018/0158633 | A1 * | 6/2018 | Brandt | H01H 47/002 |

* cited by examiner

*Primary Examiner* — Kevin J Comber
(74) *Attorney, Agent, or Firm* — Kilpatrick Townsend & Stockton LLP

(57) ABSTRACT

An electrical utility meter includes metering circuitry configured for connection to at least one utility power line and a service disconnect member. The metering circuitry is configured to receive an electrical signal corresponding to a line voltage on the at least one utility power line. The service disconnect member is configured for connection to the at least one utility power line. A control circuit is configured to deliver a control signal to the service disconnect member synchronously with a zero crossing of the electrical signal corresponding to the line voltage on the at least one utility power line.

19 Claims, 5 Drawing Sheets

| TEMP. | 1K CYCLES | 5K CYCLES | 10K CYCLES |
|---|---|---|---|
| -40 C | 8 mS | 10 mS | 15 mS |
| 20 C | 6 mS | 8 mS | 12 mS |
| +85 C | 5 mS | 7 mS | 10 mS |

METHOD AND ARRANGEMENT FOR ELECTRICAL SERVICE DISCONNECT

FIELD

This document relates to the field of electricity meters, and particularly to load disconnect devices in electricity meters.

BACKGROUND

Electrical service providers such as electrical utilities employ electricity meters to monitor energy consumption by customers (or other entities). Electricity meters track the amount of energy consumed a load (e.g. the customer), typically measured in kilowatt-hours ("kwh"), at each customer's facility. The service provider uses the consumption information primarily for billing, but also for resource allocation planning and other purposes.

Electrical power is transmitted and delivered to load in many forms. For example, electrical power may be delivered as polyphase wye-connected or delta-connected power or as single phase power. Such various forms are known as service types. Different standard electricity meter types, known as meter forms, are used to measure the power consumption for the various service types. The commonly used meter forms in the United States include those designated as 2S, 3S, 5S, 45S, 6S, 36S, 9S, 16S, 12S and 25S meter forms, which are well known in the art.

Electrical service providers have historically billed for electrical service in arrears, using information stored within the electricity meter to determine the amount of each invoice. In a typical operation, the electricity meter stores a value representative of the amount of energy consumed in a mechanical or electronic accumulation register. From time to time, the electrical service provider obtains the value of the register and bills the customer accordingly. For example, a meter reader employed by the service provider may, each month, physically read the register value off a meter display. The service provider then employs the obtained register value to determine the amount of electricity consumed over the month and bills the customer for the determined amount.

A problem with the above-described operation of electrical service providers arises from the fact that some customers are frequently delinquent in or, in default of, payments for electricity consumption. Delinquent payments can result in significant losses for the service provider. Accordingly, it is often necessary to interrupt the delivery of electrical power to some customers before losses to the service provider become excessive.

Interrupting the delivery of electrical power has historically been an expensive and significant event. Typically, a technician must be dispatched to the customer's residence, or in the vicinity thereof, to physically disconnect the power. Accordingly, while the electrical service provider might physically disconnect the power to the customer's facility for several months of complete payment default, physical disconnection is not practical in circumstances in which customers are merely delinquent, or that can only pay portions of their bills. In particular, the cost and effort of sending a technician out to disconnect electrical service is wasted if the customer pays a day or two later, thereby requiring another service call to restore service.

One method of controlling losses associated with delinquent customers is to require prepayment for services. In prepayment arrangements, customers use prepaid debit cards or credit cards to "purchase" energy in advance. When the purchased energy has been consumed, the electrical service is disconnected. Thus, the service provider is not exposed to extended periods of electrical service for which no payment may be provided. Another method of handling delinquent customers is to intermittently interrupt power to delinquent customers until the past due payments are made. Intermittent interruptions tend to reduce the amount of energy consumed by the delinquent payor, thus advantageously reducing utility provider losses while also reducing bills to the delinquent payor.

Each of the above methods, however, typically requires the ability to disconnect and/or reconnect the customer's power without a technician service call to the customer's location. For example, in a prepayment scenario, the service provider must have a method of disconnecting power once the prepaid amount of energy has been consumed. Similarly, the intermittent interruption technique requires frequent connection and disconnection of the electrical service.

One technique for automated or remote service disconnection is to employ a service disconnect switch device within an electricity meter. The service disconnect switch is a relay or other device that controllably disconnects and re-connects the utility power lines to the customer's feeder lines, thereby controllably interrupting power to the customer's facility. In some cases, the service disconnect switch is tripped by a remote device that communicates with the electricity meter circuitry through a modem, radio or the like. Alternatively, such as in the case of prepayment, the meter itself may be programmed to disconnect and reconnect electrical service under certain circumstances. In some situations, the meter may disconnect and restore electrical service through a combination of local programming and remote commands.

Thus, the inclusion of a service disconnect switch within a meter facilitates various methods and techniques for providing electrical service to parties that have poor payment records. The service disconnect switch is typically an electromechanical relay capable of handling the meter AC rated currents, for example, 100 A rms or 200 A rms. The use of a service disconnect switch advantageously may not require a permanent disconnection by a field technician. The conveniences provided by a service disconnect switch also extends beyond use in connection with delinquent payors. For example, electrical energy rationing may be implemented using techniques enabled by the service disconnect switch.

Nevertheless, various issues that arise from the use of a service disconnect switch have not been adequately addressed in the prior art. For example, in a traditional service disconnect application, upon receiving a command to open or close the service disconnect switches, the micro controller immediately drives the relays control coils to execute the command. However, after the open or close command is given, some time delay is required for the electromechanical relays to operate. Only after this time delay is the electrical disconnect switch finally opened or closed. The time when the relay contacts actually open or close is not known in current arrangements. The relay contacts may open or close when the AC line voltage is at or close to its peak voltage, causing a significant temperature rise in the contacts and arcing that deteriorates prematurely the contacts. This situation reduces the life of the relays over time and increases the temperature rise inside the electricity meter.

In view of the foregoing, there is a need for an electricity meter that employs service disconnect switch and that avoids one or more of the above described drawbacks. In particular, a need exists for an electricity meter that includes a service disconnect switch having increased safety enhancements associated with disconnecting and reconnecting a customer's electrical service. In particular, a need exists for an electricity meter with a disconnect switch that that operates efficiently without significant temperature rise in the contacts or deterioration of the contacts over time. It would also be advantageous if such electricity meter with a disconnect switch were capable of handling disconnects in both single phase and multiple phase power lines over many open/close cycles while reducing wear of the relay over time.

SUMMARY

In accordance with one exemplary embodiment of the disclosure, an arrangement for use in an electrical utility meter comprises metering circuitry, a service disconnect member, a zero crossing detector, and a control circuit. The metering circuitry is configured for connection to at least one utility power line connected to a load, and the metering circuitry is operable to generate metering information representative of an electrical quantity regarding electrical energy delivered to the load. The service disconnect member is configured for connection to the at least one utility power line. The service disconnect member has a connected state and a disconnected state. In the connected state, the service disconnect member is configured to couple the at least one utility power line to the load. In the disconnected state, the service disconnect member is configured to decouple the utility power line from the load. The zero crossing detector is configured to detect a zero voltage crossing of an electrical signal corresponding to a line voltage on the at least one utility power line. The control circuit is configured to deliver a control signal to the service disconnect member, wherein the timing of the delivery of the control signal to the service disconnect member is such that the service disconnect member either couples or decouples the at least one utility power line to the load synchronously with the zero crossing of the electrical signal.

Pursuant to another exemplary embodiment of the disclosure, a method is provided for controlling an electrical utility meter connected to at least one utility power line connected to a load. The method includes obtaining response time data for a service disconnect member associated with the electrical utility meter and determining a future zero crossing time of an electrical signal corresponding to a line voltage on the at least one utility power line. The method further comprises receiving a connect signal or a disconnect signal for the service disconnect member and then delaying delivery of a control signal configured to close or open the service disconnect member for a time such that the service disconnect member either couples or decouples the at least one utility power line to the load synchronously or in the vicinity with the zero crossing of the electrical signal.

In accordance with yet another exemplary embodiment of the disclosure, an electrical utility meter comprises metering circuitry configured for connection to at least one utility power line, the metering circuitry configured to receive an electrical signal corresponding to a line voltage on the at least one utility power line. The electrical utility meter further comprises a service disconnect member configured for connection to the at least one utility power line. In addition, the electrical utility meter comprises a control circuit configured to deliver a control signal to the service disconnect member synchronously with a zero crossing of the electrical signal corresponding to the line voltage on the at least one utility power line.

The above described features and advantages, as well as others, will become more readily apparent to those of ordinary skill in the art by reference to the following detailed description and accompanying drawings. While it would be desirable to provide an electricity meter that provides one or more of these or other advantageous features, the teachings disclosed herein extend to those embodiments which fall within the scope of the appended claims, regardless of whether they accomplish one or more of the above-mentioned advantages.

DESCRIPTION

Figure 1:
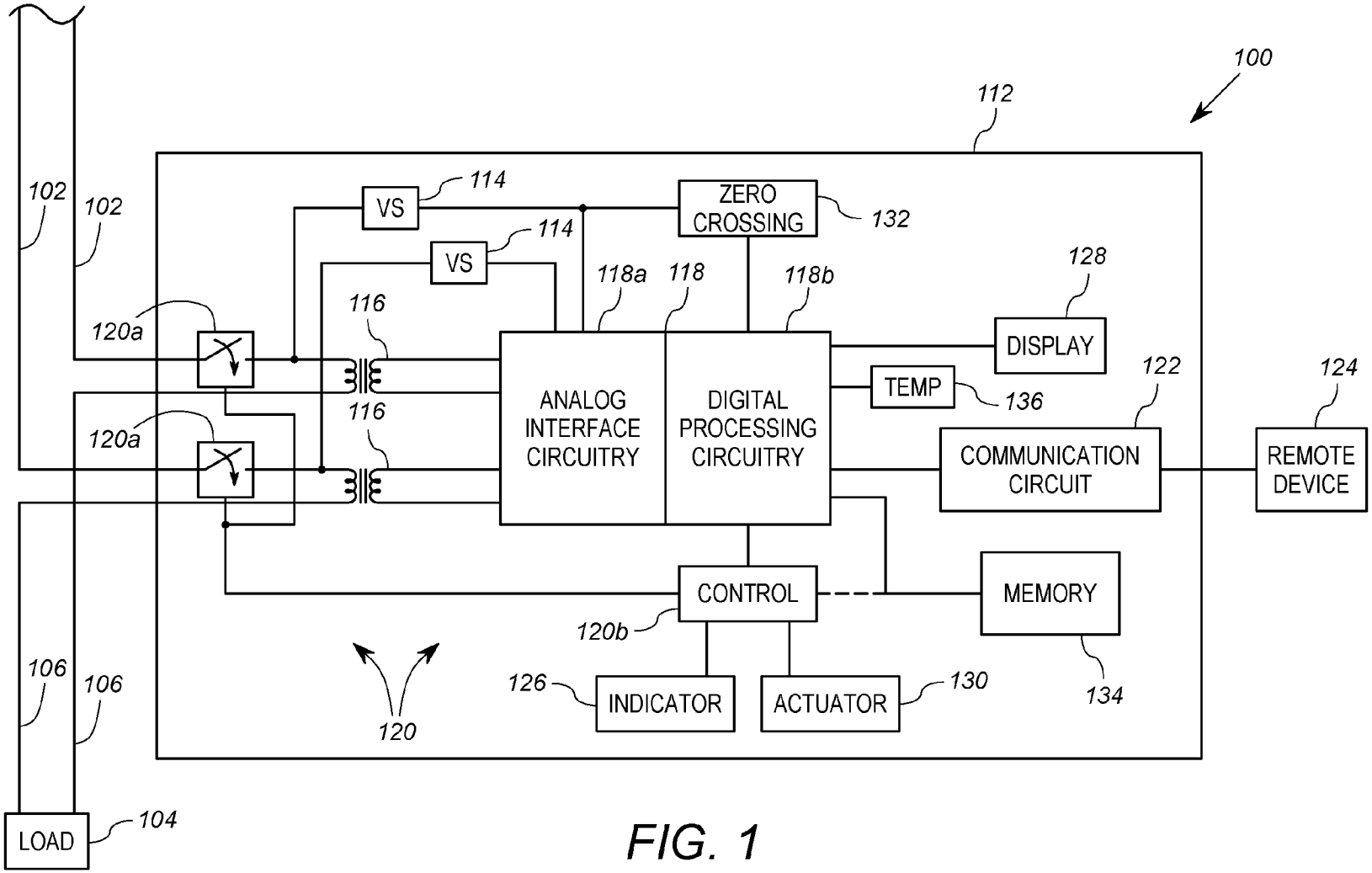
FIG. 1 shows a block diagram of an exemplary meter having a service disconnect circuit arrangement with zero crossing detection.

Referring now to the drawings, and more particularly to FIG. 1, a diagram of an electrical utility meter 100 constructed according to aspects of the present invention is shown. In FIG. 1, the meter 100 is operably coupled to utility power lines 102. The utility power lines 102 are connected to a source of electricity, such as a power transmission and distribution system, not shown. A load 104 (typically a consumer of electrical power) is connected to the power lines 102 through feeder lines 106. The meter 100 is operably coupled to the feeder lines 106 to detect the amount of electricity delivered to the load. The meter 100 is operable to, among other things, generate metering information representative of a quantity of electrical energy delivered to the load 104.

A housing assembly 112 is disposed over the meter 100 and encases various components thereof. Voltage sensors 114 and current sensors 116 are secured within the housing assembly 112, and are operable to receive voltage and current signals representative of voltage and current provided to the load 104 via the power lines 102 and generate measurement signals therefrom. In particular, the measurement signals generated by the voltage sensors 114 and current sensors 116 are analog signals each having a waveform representative of the voltage and current provided to the load 104. Suitable voltage sensor 114 and current sensors are well-known in the art. In at least one embodiment, the voltage sensors 114 are voltage dividers operably coupled to the power lines 102. Each voltage divider is configured to convert a line voltage level (or a signal representative of the line voltage level) into a low voltage or reduced signal having a waveform that is representative of the line voltage.

Suitable current sensors include current transformers configured to generate current measurements representative of the current on the power lines 102. For purposes of example and explanation, FIG. 1 illustrates two voltage sensors 114 and current sensors 116 for generating measurement signals for two-phase electrical service on the power lines 102 (e.g., phase A and phase B), or for two sides of a 240-volt single-phase three-wire electrical service. However, it will be recognized to those skilled in the art that the principles of the present invention may also be applied to single phase or three-phase power systems, such as that represented in FIG. 4, described in further detail below.

With continued reference to FIG. 1, a processing circuit 118 is operable to receive the analog measurement signals from the voltage sensors 114 and the current sensors 116 and generate energy consumption data therefrom. According to an exemplary embodiment, the processing circuit 118 includes analog interface circuitry 118*b* that receives and digitizes the measurement signals (e.g., and A/D converter), and digital processing circuitry 118*b* (which may also be referred to herein as the "metering IC") that processes the digitized measurement signals to thereby generate the energy consumption data. Such circuits are well known in the art. According to an alternative embodiment, however, the processing circuit 118 generates the energy consumption data by operating directly upon the analog measurement signals. As is known in the art, the processing circuit 118 may include one or more microprocessors or other integrated circuits. In addition to the ability to measure electrical energy consumption, the digital processing circuitry 118*b* may also provide other functions related to meter operation, as will be recognized by those of skill in the art.

The meter 100 further includes a service disconnect circuit 120 that includes service disconnect switches 120*a* and a logical control portion 120*b* (which may also be referred to herein as a "control portion," "control circuit" or a "relay driver"). One service disconnect circuit 120 is provided on each power line 102. The service disconnect switches 120*a* may be provided in any of various forms, as will be recognized by those of skill in the art. For example, the service disconnect switches 120*a* may suitably be electrically controlled switching relays, such as those relays using an electromagnet to mechanically operate a switch. However, it will be recognized that any of various types of relays or other switching devices may also be used for the service disconnect switches 120*a*, including, for example, solid state relays.

The logical control portion 120*b* of the service disconnect circuit 120 may be provided by an integrated circuit. It will be appreciated that the logical control portion 120*b* and the digital processing circuit 118*b* may suitably share some or all of the same components and/or circuitry, and therefore may be provided by a single integrated circuit or on a single circuit board. However, in other embodiments, the control portion of the service disconnect circuit and the processing circuit of the meter are completely distinct circuits. It will also be appreciated that the control portion 120*b* and the service disconnect switch 120*a* may be housed in a single structure, such as the housing assembly 112 shown in FIG. 1, or distinct structures. Moreover, in at least one embodiment, the control portion 120*b* may located on a circuit board that is distinct from the service disconnect switch 120*a*.

With continued reference to FIG. 1, one or more service disconnect switches 120*a* are operably coupled to the logical control portion 120*b* and the processing circuit 118 within the housing assembly 112. The service disconnect switches 120*a* selectively connect and disconnect the power lines 102 to the load 104 under the control of the logical control portion 120*b* and the associated processing circuit 118. As discussed previously, the service disconnect switches typically include relays or other electromechanical devices where some delay occurs between the time a command is delivered to the device to open or close and the time when the contacts of the device actually open or close. The average service disconnect relay response time is a function of several parameters, including: (a) the type of service disconnect relay used (e.g., DC motor driven, bi-stable electromechanical relay, etc., (b) aging of the relay (given in terms of number of cycles executed), and (c) environmental factors such as temperature and humidity.

In general, the service disconnect circuit 120 has a connected state and a disconnected state. The states of the service disconnect circuit 120 are maintained within the control portion 120*b*. The control portion 120*b* controls the service disconnect switches 120*a* in accordance with the state logic. More specifically, in the connected state, the service disconnect switch 120*a* operably couples the power lines 102 to the load 104 so as to provide electrical power thereto. In the disconnected state, the service disconnect switch 120*a* operably decouples the power lines 102 from the load 104 so as to remove the supply of electrical power therefrom. Indeed, the control portion 120*b* of the service disconnect switch may constitute a portion of the processing circuit 118 of the meter.

The service disconnect circuit 120 changes from the connected state to the disconnected state in response to a first signal received from the processing circuit 118. Similarly, the service disconnect circuit 120 changes from the disconnected state to the connected state in response to a second signal received from the processing circuit 118. It should be noted that the signals that cause the state changes may be provided on one or more physical lines.

A communication circuit 122 is operably coupled to the processing circuit 118, and is also operable to receive signals from a remote device 124. The remote device may be any of various devices in communication with the meter 100, and particularly a utility owned or controlled device, such as remote utility computer, an automated meter reader (AMR) device, or the like. The communication circuit 122 may, for example, receive signals from the remote device 124 via a tangible communication link (e.g., cable, telephone wire, fiber, etc.), or via a wireless communication link.

According to one aspect of the disclosure, the communication circuit 122 is operable to receive a disconnect signal from the remote device 124. In response to the disconnect signal, the communication circuit 122 provides information representative of the disconnect signal to the processing circuit 118. The processing circuit 118 in turn provides the first signal to the control portion 120*b* of service disconnect circuit 120, thereby causing the service disconnect circuit 120 to change from the connected state to the disconnected state. In the disconnected state, the service disconnect switches 120*a* disconnect the feeder lines 106 from the power lines 102.

The communications circuit 122 is further operable to receive a connect signal from the remote device 124. In response to the connect signal, the communications circuit 122 provides information representative of the connect signal to the processing circuit 118. The processing circuit 118, in turn provides the second signal to the control portion 120*b* of the service disconnect circuit 120, thereby causing the service disconnect circuit to change from the disconnected state to the connected state. In the connected state, the service disconnect switches 120*a* connect the feeder lines 106 to the power lines 102.

It will be recognized that in at least one embodiment, the communication circuit 122 is further operable to receive an arm signal from the remote device 124. The arm signal may be in lieu of the connect signal described in the preceding paragraph. In response to the arm signal, the communication circuit 122 provides information representative of the arm signal to the processing circuit 118. The processing circuit 118 in turn provides a third signal to the service disconnect circuit 120, thereby causing the service disconnect circuit 120 to change from the disconnected state to the armed state. In the armed state, the switches 120*a* do not immediately reconnect the feeder line 106 to the power lines 102. When in the armed state, the service disconnect circuit 120 is configured to change from the armed state to the connected state responsive to actuation of an externally accessible actuator 130, thus delaying reconnection of the feeder lines 106 to the power lines until a human physically present at the meter indicates that reconnection is actually desired at that time. An example of a meter having a service disconnect circuit with an armed state is described in U.S. Pat. No. 7,363,232, the contents of which are incorporated herein by reference.

In the embodiment of FIG. 1, one or more electronic indicators 126 are operably coupled to the control portion 120*b* and provide visual signals regarding operation of the service disconnect circuit 120. Each indicator 126 may, for example, be embodied as an indicator lamp comprising a light emitting diode, or as a liquid crystal display segment. According to an exemplary embodiment, each indicator 126 is visible external to the housing assembly 112 and is operable to provide a visual signal representative of the current state of the service disconnect circuit 120. For example, the indicator 126 may include a first indicator lamp that provides a visual signal indicative of one or more service disconnect switches 120 in the connected state, or alternatively the armed state, and a second indicator lamp that provides a visual signal indicative of one or more service disconnect switches 120 in the disconnected state. Alternatively, the indicator 126 may be embodied as a single element which provides a first visual signal indicative of one or more service disconnect switches 120 in the connected or armed state, and a second visual signal indicative of one or more service disconnect switches 120 in the disconnected state. It will be appreciated that in alternative embodiments, the indicators 126 may be connected to the processing circuit 118 as opposed to the control portion 120*b* of the service disconnect circuit 120.

A display 128 is operably coupled to the processing unit 118 and provides a visual display of information, such as information regarding the operation of the meter 100. For example, the display 128 may provide a visual display regarding the power measurement operations of the meter 100. The display 128 and the indicator 126 may be separate and distinct elements of the meter 100, as shown in FIG. 1, or may be combined into a single display unit.

An actuator 130 is operably coupled to each service disconnect switch 120. When actuated, the actuator 130 causes one or more service disconnect switches 120 to change from an armed state to the connected state. The actuator 130 is coupled to the control portion 120*b* of the service disconnect switch 120, or may be directly coupled to each service disconnect switch 120. The actuator 130 is preferably disposed on the housing assembly 112, and is accessible from an external portion of the housing assembly 112. The actuator 130 may, for example, be embodied as one or more pushbutton mechanisms or other elements that may be actuated by a user.

At least one zero crossing detector 132 is coupled to the voltage sensors 114. The zero crossing detector 132 includes an input received from one of the voltage sensors 114 and an output that is delivered to the digital processing circuitry 118*b*. In the exemplary embodiment of FIG. 1, only one zero crossing detector 132 is coupled to the voltage sensors. In this arrangement, the zero crossing detector 132 may be coupled to the voltage sensor 114 such that it detects a zero crossing on the phase A power line, but not on the phase B power line. Alternatively, in at least one embodiment, multiple zero crossing detectors 132 may be provided such that the zero crossing of electrical service on each powerline 102 is detected.

Figure 2:
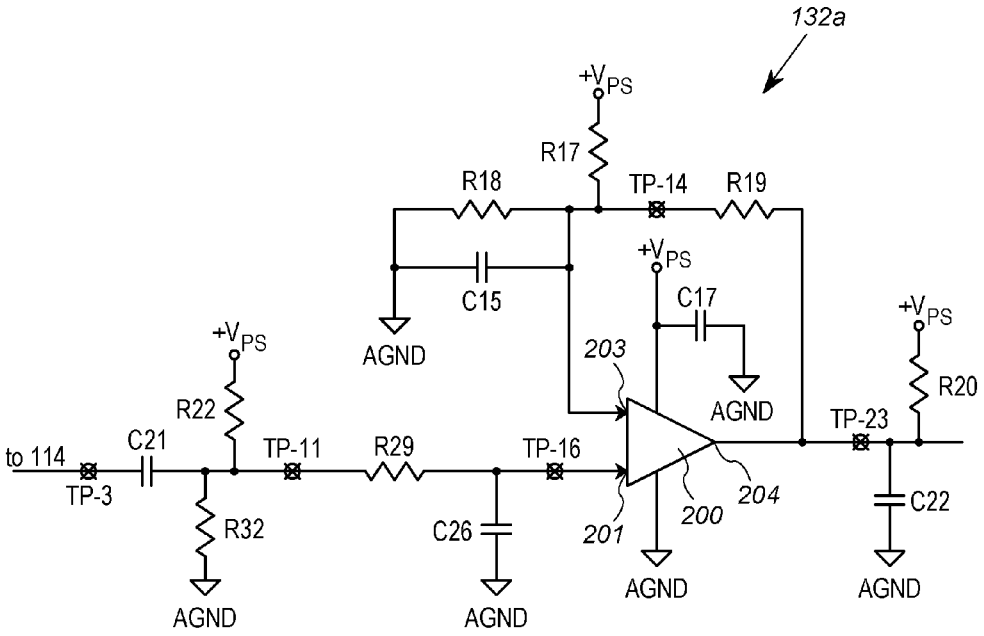
FIG. 2 shows a simplified block diagram of an embodiment of a zero crossing detector for use in the exemplary meter of FIG. 1.

The zero crossing detector 132 may be provided in any of various forms, as will be appreciated by those of skill in the art. FIG. 2 shows an exemplary zero crossing detector 132*a* using an operation amplifier 200. The operational amplifier 200 includes an inverting input 201 which is coupled to the voltage sensor 114 via the capacitor C21, a non-inverting input 203 which is connected to a reference voltage, the reference voltage being set by the resistors R17 and R18, a positive power supply $+V_{PS}$ (which may be e.g., +3.3 VDC), GND, and an output 204 (i.e., $V_{OUT}$) 204. The zero crossing detector 132*a* is configured to generate a pulse signal at the pulse output 204 responsive to the detection of either a positive slope zero crossing or negative slope zero crossing of a signal $V_{IN}$ (TP-3) received from the voltage sensor 114.

Figure 3:
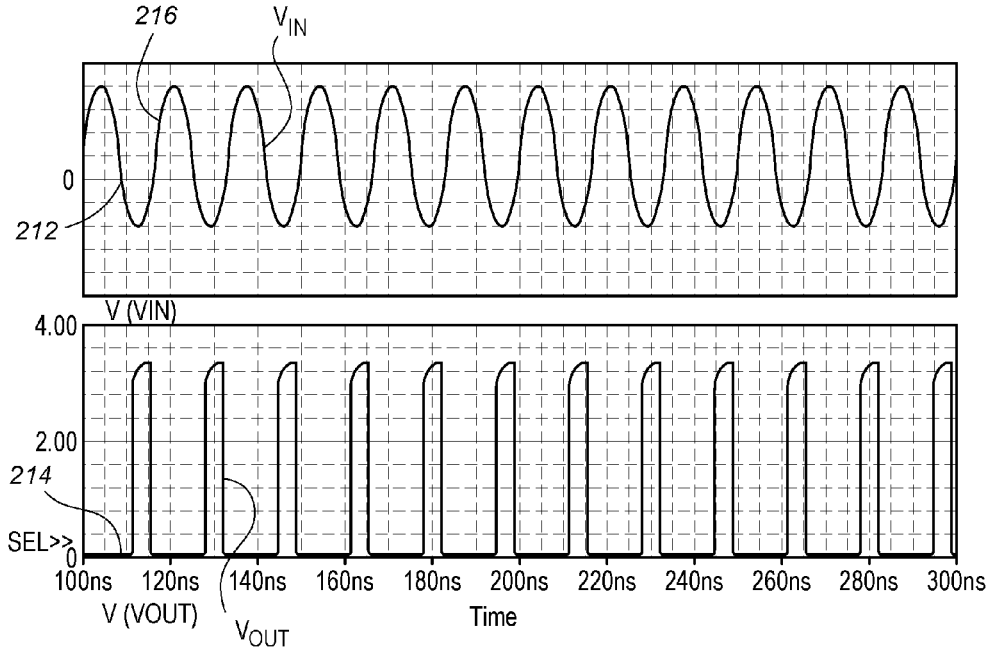
FIG. 3 shows a signal timing diagram of the input and output signals for the zero crossing detector of FIG. 2.

FIG. 3 shows an example of the input and output of the zero crossing detector 132*a* of FIG. 2. The input signal $V_{IN}$ is received from the voltage sensor 114 and corresponds to a line voltage on the at least one utility power line 102 associated with the voltage sensor 114. As shown in FIG. 3, the input signal $V_{IN}$ is a typical sine wave as is expected as the line voltage on an alternating current power line 102. The output signal $V_{out}$ is provided to the digital processing circuitry 118*b*. As shown in FIG. 3, the output signal $V_{out}$ is a pulse signal responsive to either the detection of either a positive slope zero crossing or a negative slope zero crossing of the input signal $V_{IN}$. In particular, in the embodiment of the zero crossing detector 132*a* of FIGS. 2 and 3, when the input signal $V_{IN}$ crosses zero and goes from positive value to a sufficiently negative value (e.g., see point 212 in FIG. 3), the output signal $V_{out}$ pulses from a zero value to a positive value (e.g., see point 214 in FIG. 3). When the input signal $V_{IN}$ crosses zero and goes from negative to positive (e.g., see point 216 in FIG. 3), the output signal $V_{out}$ remains in zero value. Accordingly, each pulse of the output signal $V_{out}$ indicates a new negative slope zero crossing of the line voltage. While positive pulses represent negative slope zero crossings in FIG. 3, it will be appreciated that the zero crossing detector 132*a* of FIG. 2 may be arranged differently such that positive pulses represent positive slope zero crossings and zero pulses represent negative slope zero crossings, vice-versa, or any of various other pulse indicators for zero crossings. The output of the zero crossing detector 132 is delivered to the digital processing circuitry 118*b*. This signal from the zero crossing detector 132 allows the digital processing circuitry to track at least one zero crossing (or multiple zero crossings in a poly phase system).

With reference again to FIG. 1, the meter 100 further includes a memory 134 coupled to the digital processing circuitry 118*b* and/or the logical control portion 120*b* of the service disconnect arrangement 120. The memory 134 retains data and instructions for execution by the digital processing circuitry 118*b* and/or the logical control portion 120*b*. The memory 134 may be of any type of device capable of storing information accessible by the digital processing circuitry, such as non-volatile memory, a memory card, ROM, RAM, write-capable memories, read-only memories, hard drives, discs, flash memory, or any of various other computer-readable medium serving as data storage devices as will be recognized by those of ordinary skill in the art. Portions of the system and methods described herein may be implemented in suitable software code that may reside within the memory as software or firmware.

Figure 5:
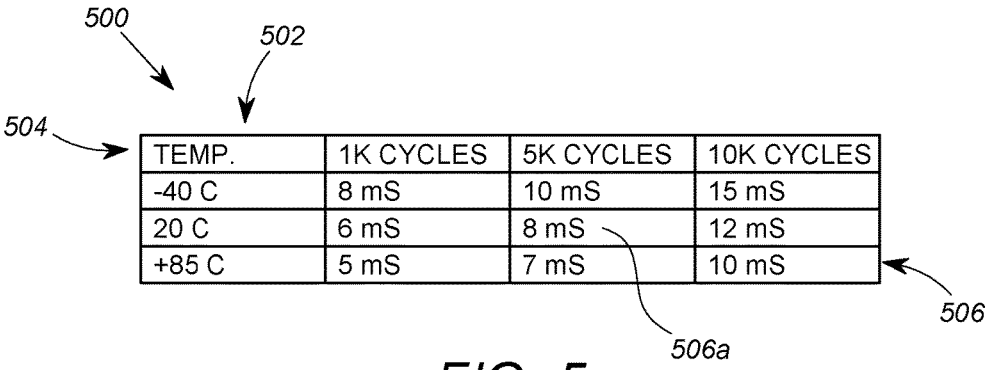
FIG. 5 shows an exemplary relay response time table stored in the memory of the meter of FIG. 4.

The memory 134 is configured to store data for use by the digital processing circuitry 118*b* as well as data generated by the digital processing circuitry 118*b*. For example, the memory is configured to store electrical energy consumption data generated by the digital processing circuitry. In addition, in at least one embodiment, the memory 134 is configured to store relay response time data for each of the service disconnect switches 120*a*. As noted previously, relay response time is dependent upon a number of different factors. Relay response time data may be pre-programmed into the meter for each particular type of relay used as one of the service disconnect switches 120*a*. The relay response time data may be provided in any of various forms such as records or look-up tables. An exemplary look-up table with response times for a particular relay based on current temperature and total cycles executed by the relay is shown in FIG. 5 and discussed in further detail below. As noted previously, the average service disconnect relay response time is a function of several parameters, including: (a) the type of service disconnect relay used (e.g., DC motor driven, bi-stable electromechanical relay, etc., (b) aging of the relay (given in terms of number of cycles executed), and (c) environmental factors such as temperature and humidity. Accordingly, the table of FIG. 5 is provided for a particular type of service disconnect relay, and includes data concerning the number of cycles already executed for the relay and the current ambient temperature. Based on this information, various response times may be determined. FIG. 5 illustrates that these response times may vary significantly depending on the cycles and the current environmental factors. In the example table 500 of FIG. 5 the relay response times vary between 5 ms and 15 ms. When relay response time data is required, as explained in further detail below, the digital processing circuitry accesses the memory and retrieves the appropriate response time information from the relay response time data stored in the memory 134.

With reference again to FIG. 1, the meter 100 further includes one or more environmental sensors, such as the temperature sensor 136, coupled to the digital processing circuitry. The temperature sensor 136 is preferably positioned in proximity of the service disconnect switches 120*a*, and therefore provides an accurate representation of the current temperature of the service disconnect switches 120*a*. In addition to the temperature sensor 136, additional environmental switches may also be provided, such as humidity sensors, pressure sensors, etc. The digital processing circuitry 118*b* uses the information provided from the environmental sensors to obtain the most relevant relay response time data from the memory 134.

Figure 4:
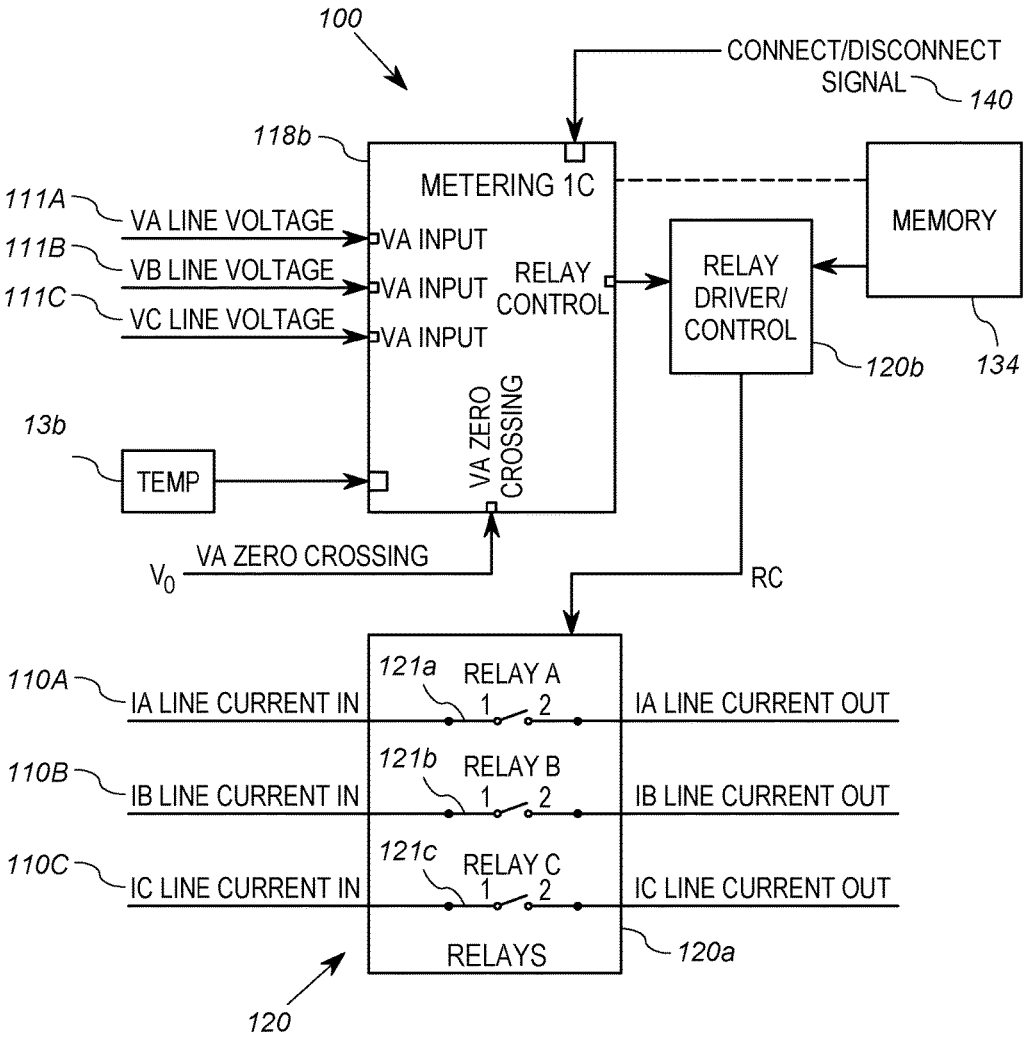
FIG. 4 shows a simplified block diagram of an alternative embodiment of the electrical utility meter of FIG. 1 including digital processing circuitry and a service disconnect arrangement for use in a three phase system.

As noted previously, the meter 100 of FIG. 1 is configured to generate measurement signals for two-phase electrical service on the power lines 102 (e.g., phase A and phase B), or for two sides of a 240-volt single-phase three-wire electrical service. However, it will be recognized that in at least one embodiment the meter 100 of FIG. 1 may similarly be used in association with a single phase or three-phase power systems. FIG. 4 shows a simplified block diagram of the metering IC 118*b* and the service disconnect circuit 120 within the meter 100 for a three-phase power system. As shown in FIG. 4, the metering IC 118*b* is configured to receive line voltage signals 111A, 111B, and 111C, each corresponding to a line current on each of the three utility power lines (i.e., phase A line current 110A, phase B line current 110B, and phase C line current 110C shown in FIG. 4).

In addition to the line voltage signals 111A, 111B, and 111C, the metering IC 118*b* is also configured to receive a zero crossing signal $V_0$ for a single phase line voltage (e.g., phase A). While a single zero crossing signal $V_0$ is shown in FIG. 4, it will be recognized that in alternative embodiments multiple zero crossing detectors may be used, or alternatively, the metering IC 118*b* itself may provide the zero crossing detector without the need for any specialized separate hardware. In particular, because the metering IC 118*b* senses all three AC line voltages (111A, 111B, 111C) (and the associated currents), the zero crossing of all the line voltages may be generated by the metering IC or with the assistance of specialized electronic hardware (S4e and S4X products) to generate independent zero crossing signals. In any event, the metering IC 118*b* may be configured to calculate all three zero crossings for a three phase system based on sensing the service type (e.g., in a delta or wye service type) and one zero crossing signal (i.e., based on a delta or wye service, if one line voltage zero crossing is known, the remaining two zero crossings can then be calculated). The metering IC 118*b* is typically configured to calculate a predetermined number of upcoming zero crossings in the future (e.g., within a one second or less period of time) for each of the three phase voltages. As explained in further detail below, with these future zero crossings known, the system can calculate an appropriate delivery time for the relay control signal to each service disconnect switch.

In addition to the zero crossing signal, the metering IC 118*b* of FIG. 4 is also configured to receive a temperature signal from the temperature sensor 136 mounted within or in proximity to the meter 100. This temperature signal is used by the metering IC 118*b* to retrieve the appropriate relay response time data from the memory 134. While only a temperature sensor 136 is shown in the embodiment of FIG. 4, it will be recognized that other environmental sensors may also be used to provide input signals to the metering IC 118*b* for the purpose of retrieving the appropriate relay response time data from the memory 134.

In addition to the zero crossing signal, the metering IC 118*b* of FIG. 4 is configured to receive a connect/disconnect signal 140 from the communications circuit and/or from the actuator of the meter. When the connect/disconnect signal 140 is received from the communications circuit, it is typically provided from a remote device (such as remote device 124 of FIG. 1). However, when the connect/disconnect signal 140 is received from the actuator (such as actuator 130 of FIG. 1), the communications circuit has typically already placed the service disconnect circuit 120 in the armed state, but the service disconnect circuit has yet to be opened or closed by virtue of physical activation of the actuator.

With continued reference to FIG. 4, the metering IC 118*b* is coupled to the relay driver 120*b*. As noted previously, although the relay driver 120*b* is shown separate from the metering IC 118*b* in FIG. 4, in at least one embodiment the relay driver 120*b* is provided by the same microcontroller or other integrated circuit as the metering IC 118*b*. The metering IC 118*b* is configured to deliver relay control signals to the relay driver/control 120*b*. These relay control signals are typically sent following receipt of the connect/disconnect signal 140 from the communications circuit or the actuator. As explained in further detail below, after receiving the control signal from the metering IC 118*b*, the relay driver 120*b* adjusts the timing of the relay control signal to compensate for the relay response time of the service disconnect switches 120*a*. In particular, the relay driver 120*b* adjust the timing of the relay control signal by anticipating a future zero crossing of the AC line voltage and timing delivery of the relay control signal to the relays to effectively open or close the service disconnect switches 120*a* at a zero crossing vicinity of the AC line voltage. It will be recognized that the relays effectively open or close the service disconnect switches in the vicinity of the zero crossings (rather than at the precise zero crossings) as a result of the hysteresis included in the zero crossing detector.

In the embodiment of FIG. 4, relays 121*a*, 121*b* and 121*c* are provided as the service disconnect switches 120*a*. As noted previously, the service disconnect relays 121*a*, 121*b* and 121*c* may be provided in any of various forms such as motor driven relays or electromechanical relays. For each particular service disconnect relay type used (e.g., motor driven relay, electromechanical relay, etc.), there is a table stored in a database that contains the different relay response times as a function of the ambient temperature and number of cycles already executed by the relays. The database table is stored in the memory 134 at the factory during the factory calibration of the meter. The database is then available for reference by the metering IC 118*b* when the meter 100 is in use in the field. Additionally, the memory 134 maintains a running count of cycles for each of the service disconnect relays 121*a*, 121*b* and 121*c*. Accordingly, while the meter 100 ages and processes various disconnect and connect commands, the meter increments the cycle count with each disconnect or connect command. While FIG. 4 shows the memory 134 separate from the metering IC 118*b*, it will be recognized that in at least one embodiment, the memory 134 may be provided as part of the metering IC 118*b* or provided on a common board with the metering IC 118*b*.

FIG. 5 depicts an exemplary table 500 providing response times for an exemplary relay (e.g., particular brand of disconnect relay with a particular rating for use in residential or industrial meters). The cells in the left hand column 502 of the table 500 list various operating temperatures for the relay. The cells top row 504 of the table 500 (starting in the second column) list a number of cycles of the relay (i.e., the number of times the relay contacts have been connected and disconnected). The cells 506 at the intersection of a column and a row provide a relay response time based on the associated temperature and number of relay cycles. For example, at 20° C. and 5K cycles, the cell 506*a* shows that the relay response time will be 8 mS.

Figure 6:
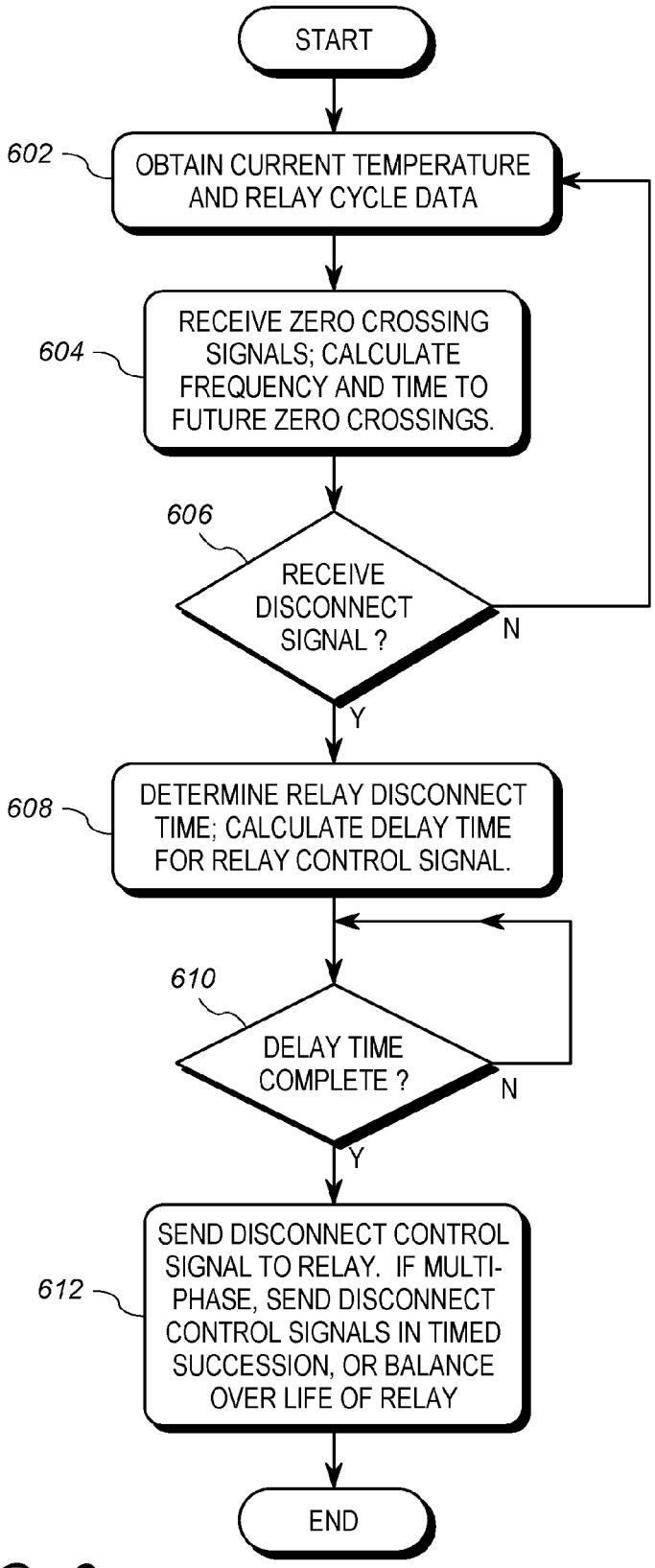
FIG. 6 shows a method of operating a service disconnect switch in the electrical utility meter of FIG. 4.

With reference now to FIG. 6, a method of operating a service disconnect switch in a meter is shown. In the description of the method herein, a statements that a method is performing some task or function refers to a controller, or general purpose processor executing programmed instructions stored in non-transitory computer readable storage media operatively connected to the controller or processor to manipulate data or to operate one or more components in the meter 100 to perform the task or function. Particularly, the metering IC 118*b* described above can provide such a controller or processor. Alternatively, the controller can be implemented with more than one processor and associated circuitry and components, each of which is configured to form one or more tasks or functions described herein. Additionally, the steps of the methods may be performed in any feasible chronological order, regardless of the order shown in the figures or the order in which the steps are described.

The method of FIG. 6 starts in step 602 with the metering IC 118*b* obtaining the current temperature from the temperature sensor 136 and cycle data for the relay installed in the meter 100 from the memory 134. Then, in step 604, the metering IC 118*b* detects the line voltages 111A, 111B, and 111C, and the associated zero crossing signals.

Following step 604 the method continues to step 606 and determines whether a disconnect (or connect) signal has been received from the communications circuit of the meter (or from the actuator). If a disconnect (or connect) signal has not been received by the meter, the method returns to step 602. However, if a disconnect (or connect) signal has been received, the method continues to step 608. At step 608, the method continues by determining a relay disconnect (or connect) time. This is determined by obtaining the number of relay cycles stored in memory and the current temperature, and then looking up the relay response time (e.g., 8 ms) in the relay response time table (e.g., table 500) stored in memory 134.

After determining the relay disconnect time, the method continues in step 608 by determining the next zero crossing time for at least one phase of the line voltage. Then, this next zero crossing time is adjusted by the relay response time determined from the table. The difference between the time to the next zero crossing and the relay response time is a delay time that should expire before a desired delivery time when the relay control signal should be sent to the relay.

In step 610 of FIG. 6, the method continues by determining whether the delay time has passed. If the delay time has not passed, the method waits and does not send a control signal to the relay. However, after the delay time has passed, the method continues to step 612, and a disconnect control signal (or a connect control signal) is sent to the relay. Because the control signal was sent at a precise time prior to the zero crossing of the line voltage, the relay has sufficient time to close (or open) in synchronization with the zero crossing of the line voltage. It will be recognized that the phrase "in synchronization with the zero crossing" or "synchronously with a zero crossing" refers to a time that is substantially the same as or in the near vicinity of the zero crossing, but may not be exactly the same time as the zero crossing. For example, for a 60 Hz waveform, a time in synchronization with the zero crossing may include a time that is within 1 ms of the zero crossing.

As also noted in step 612, in a three phase system, the disconnect (or connect) control signals are either (i) sent in timed succession or (ii) balanced over time (i.e., over the life of the relay). If the disconnect (or connect) control signals are sent in timed succession, each of the phase A, phase B, and phase C line voltages are successively disconnected (or connected) at a zero crossing. This method is particularly useful with a disconnect switch arrangement wherein each of the phase A, phase B, and phase C disconnects may be individually controlled. Disconnect of each of the phase A, phase B, and phase C line voltages in timed succession is described in further detail below in FIG. 7. However, in at least one alternative embodiment useful for disconnect switch arrangements wherein the phase A, phase B, and phase C disconnects are controlled simultaneously, the disconnect control signals are balanced over the life of the relay between phase A, phase B and phase C zero crossings. In this arrangement, each successive disconnect (or connect) control signal is timed with a different one of the phase A, phase B, or phase C zero crossings. In other words, in a three phase system, only one phase (A, B or C) will be switching in the vicinity of its zero crossing point during the execution of a connect or a disconnect command. This limits excessive wear on one of the three switches associated with the zero crossing phase, but results in excessive wear on the other phases. Thus, to balance the wear on each phase over the life of a three phase disconnect meter, the metering IC 100 keeps counters associated with the history of each relay zero crossing actuation (connect or disconnect) that are used to successively synchronized with the Phase A or Phase B or Phase C.

The above-described method for computing a correction for the zero crossing based on the relay response time provides a close approximation to the actual zero crossing relay operation. By synchronizing the open/close relay operation to the AC line voltage zero crossings, the life of the service disconnect relays are extended, keeping the relay contact resistance low and reducing the temperature rise inside the electricity meter.

Figure 7:
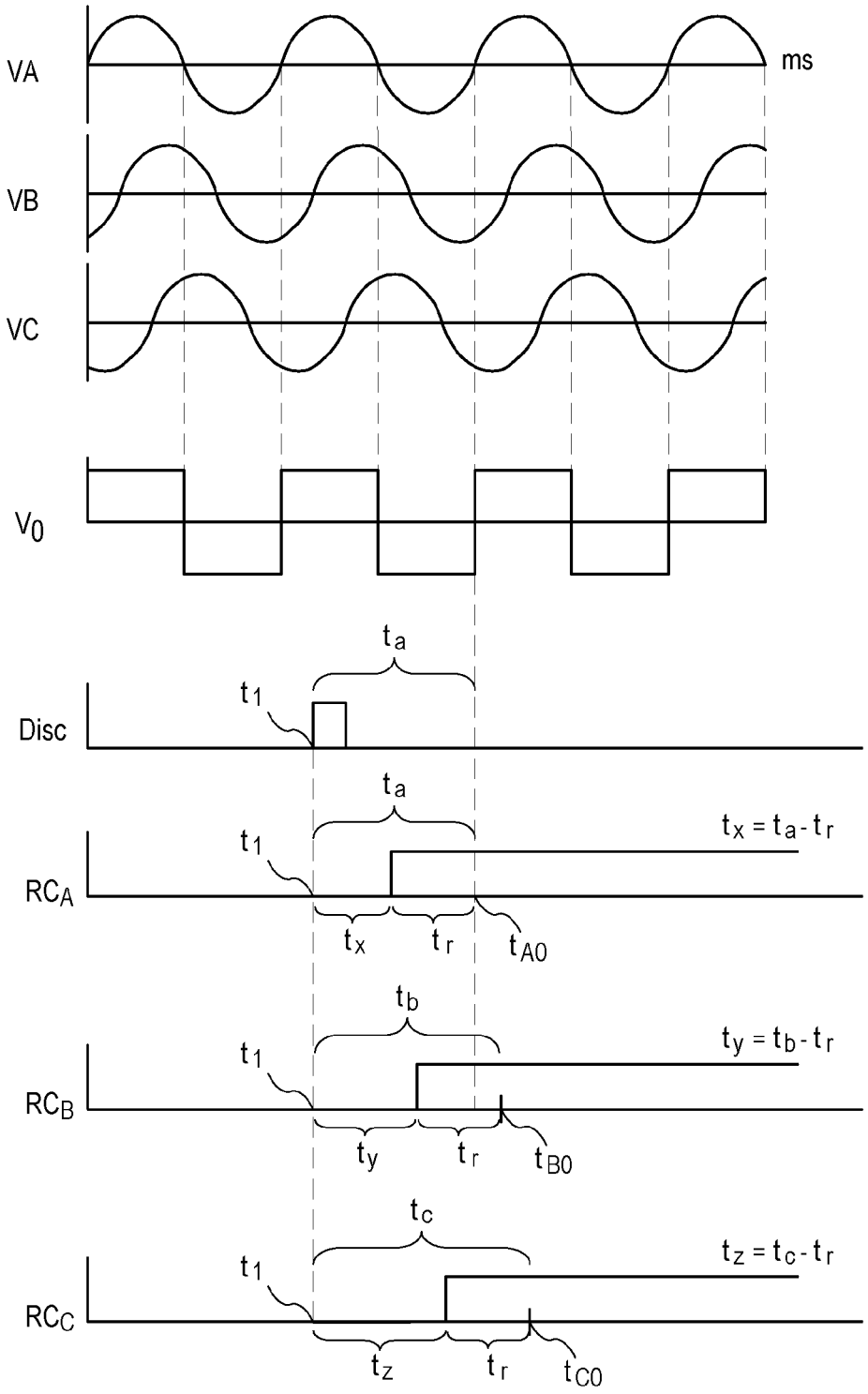
FIG. 7 shows a signal timing diagram for the electrical utility meter of FIG. 4.

With reference now to FIG. 7, an example of timing diagram for a meter using the method of FIG. 6 is shown. In FIG. 7, the first three waveforms show exemplary voltage signals received at the metering IC 118*b* corresponding to the line voltages VA, VB, and VC. The waveform associated with the signal $V_0$ is also received at the metering IC 118*b* is representative of the zero crossings for the VA line voltage. As shown in FIG. 7, the zero crossings of the VA line voltage are all aligned with the pulse transition of the $V_0$ signal. Accordingly, by monitoring the $V_0$ signal, a zero crossing of the VA line voltage is indicated each time the $V_0$ signal transitions from the high voltage to the low voltage, or vice-versa.

With the line voltages VA, VB and VC and the zero crossing $V_0$ known, the metering IC 118*b* calculates the frequency of the line voltages VA, VB and VC. With the frequency calculated, the time of each successive zero crossing can be determined immediately after the last zero crossing. For example, if the line voltage has a frequency of 60 Hz, it can be known that the next zero crossing will occur 8.333 ms (i.e., 16.666 ms/2) after the last zero crossing. Also, if the zero crossing for one of the phase voltages (e.g., VA) is known, the zero crossings for the other phase voltages can also be determined.

With the zero crossings of the phase voltages known, the relay control signal can be timed such that the relay opens or closes synchronously with a zero crossing of a phase voltage. FIG. 7 shows an exemplary disconnect signal "DISC" received by the processor at time ti. Upon receipt of this disconnect signal, the metering IC determines that a zero crossing for the phase A line voltage will occur at a time $t_a$ (e.g., 14 ms) in the future, a zero crossing for the phase B line voltage will occur at a time $t_b$ in the future, and a zero crossing for the phase C line voltage will occur at a time $t_c$ in the future. In addition, the processor has obtained the relay response time for each relay from the memory. In the example of FIG. 7, the relay response time is a time $t_r$ (e.g., 8 ms). By subtracting $t_r$ from $t_a$, the processor generates a delay time $t_x$ (i.e., $t_x=t_a-t_r$) that should expire before the relay control signal $RC_A$ is delivered to the service disconnect relay for the phase A line voltage. As an example, if the future zero crossing time $t_a$ is 14 ms away, and the relay response time $t_r$ is 8 ms, the delay time $t_x$ will be 6 ms (i.e., 14 ms−8 ms=6 ms). After this time delay expires, the relay control signal $RC_A$ is sent, as shown in FIG. 7. Similarly, the relay controls signals $RC_B$ and $RC_C$ are sent following expiration of the $t_y$ and $t_z$ time delays, as shown in FIG. 7.

As shown in the example of FIG. 7, once the metering IC receives an open/close command, it computes the next zero crossing times for each phase adjusted by the relay response time. Since in the general case of a three phase system each relay has a different crossing time, the first close/open command will be synchronized with phase A, the next one with phase B, and then with phase C. If each disconnect control switch (e.g., 121*a*, 121*b*, and 121*c* in FIG. 4) may be controlled individual (i.e., separately controlled), the open/close commands for each disconnect control switch are provided in timed succession over a short period (e.g., within 16-17 ms for a 60 Hz line voltage). However, if the three disconnect control switches (e.g., 121*a*, 121*b*, and 121*c* in FIG. 4) are collectively controlled (i.e., all at once), the open/close command for only one of the disconnect control switches will be timed in the vicinity of the zero crossing for the associated line voltage (e.g., the phase A line voltage). Then, when future open/close commands are sent for the disconnect switches, the open/close command will be timed in the vicinity of a zero crossing for a different line voltage (i.e., the phase A or phase B line voltage). The process will repeat over the life of the service disconnect relays such that the open/close commands are balanced with the zero crossings of each of the phase A, phase B, and phase C zero crossings. Use of the disclosed arrangement and methodology balances the total number of cycles of each individual relay over the life of the relays and the associated wear and tear due to opening/closings at the rated current (e.g., 100 Arms, 200 Arms, etc.). For example, if the relay has opened and closed three-hundred times, about one hundred openings and closings will be synchronized with the zero crossing of the phase A line voltage, about one hundred openings and closings will be synchronized with the zero crossing of the phase B line voltage, and about one hundred openings and closing will be synchronized with the zero crossing of the phase C line voltage. While this example of open/close commands "balanced" with the zero crossings of each line voltage anticipates an equal number of openings and closings synchronized with the zero crossings for each phase, it will be recognized that in some alternative embodiments the balancing may be different. For example in one embodiment, the number of openings and closings for each phase may not be equal such that the balancing of the disconnect control signals over the life of the relay is different (e.g., ninety phase A zero crossing open/close commands, one-hundred fifteen phase B zero crossing open/close commands, and ninety-five phase C zero crossing open/close commands over the life of a relay with three hundred opening/closings).

The foregoing detailed description of one or more exemplary embodiments of the method and arrangement for electrical service disconnect has been presented herein by way of example only and not limitation. It will be recognized that there are advantages to certain individual features and functions described herein that may be obtained without incorporating other features and functions described herein. Moreover, it will be recognized that various alternatives, modifications, variations, or improvements of the above-disclosed exemplary embodiments and other features and functions, or alternatives thereof, may be desirably combined into many other different embodiments, systems or applications. Presently unforeseen or unanticipated alternatives, modifications, variations, or improvements therein may be subsequently made by those skilled in the art which are also intended to be encompassed by the appended claims. Therefore, the spirit and scope of any appended claims should not be limited to the description of the exemplary embodiments contained herein.

What is claimed is:

1. An arrangement for use in an electrical utility meter comprising:

metering circuitry configured for connection to at least one utility power line connected to a load, the metering circuitry operable to generate metering information representative of an electrical quantity regarding electrical energy delivered to the load;

a service disconnect member configured for connection to the at least one utility power line, the service disconnect member having a connected state and a disconnected state, the service disconnect member configured to couple the at least one utility power line to the load in the connected state and configured to decouple the utility power line from the load in the disconnected state, wherein the service disconnect member includes three relays configured for connection to three-phase utility power lines, each relay having a connected state and a disconnected state, and each relay configured to couple one phase of the three-phase utility power lines to the load in the connected state and configured to decouple the one phase of the three-phase utility power lines from the load in the disconnected state;

a zero crossing detector configured to detect one or more zero crossings of an electrical signal corresponding to a line voltage on the at least one utility power line; and a control circuit configured to deliver a control signal to the service disconnect member at a delivery time, wherein the delivery time is calculated to time delivery of the control signal to the service disconnect member such that the service disconnect member either couples or decouples the at least one utility power line to the load synchronously with the one or more zero crossings of the electrical signal, wherein the service disconnect member balances coupling or decoupling of each phase of the three-phase utility power lines synchronously with an associated zero crossing of such phase over time, and wherein balancing the coupling or decoupling of each phase comprises:

identifying a first zero crossing of a first phase of the three-phase utility power lines;

timing a first simultaneous disconnect of three phases of the three-phase utility power lines to the first zero crossing of the first phase of the three-phase utility power lines;

identifying a second zero crossing of a second phase of the three-phase utility power lines;

timing a second simultaneous disconnect of the three phases of the three-phase utility power lines, subsequent to the first simultaneous disconnect, to the second zero crossing of the second phase of the three-phase utility power lines; and balancing a quantity of disconnects of the three phases timed to zero crossings of the first phase with a quantity of disconnects of the three phases timed to zero crossings of the second phase.

2. The arrangement of claim 1 wherein the service disconnect member includes at least one electromechanical relay.

3. The arrangement of claim 2 further comprising a memory including relay response time data, wherein the control circuit is configured to receive the relay response time data from the memory and time delivery of the control signal to the service disconnect member based on the relay response time data.

4. The arrangement of claim 3 wherein the relay response time data includes at least one relay response time table, the at least one relay response time table including a plurality of relay response times based on temperature and total relay cycles of the at least one electromechanical relay.

5. The arrangement of claim 3 further comprising a communication circuit, wherein the communication circuit is configured to receive a connect signal or a disconnect signal from a remote device via the communications circuit.

6. The arrangement of claim 5 wherein the control circuit is configured to (i) determine a future zero crossing time of the electrical signal corresponding to the line voltage on the at least one utility power line, (ii) after receiving the connect or disconnect signal from the remote device, determine an desired delivery time for the control signal to the service disconnect member based on the relay response time data and the determined future zero crossing time, and (iii) after determining the desired delivery time, delay delivery of the control signal to the service disconnect member until the desired delivery time such that the service disconnect member either couples or decouples the at least one utility power line to the load synchronously with the future zero crossing time of the electrical signal.

7. The arrangement of claim 5 wherein the metering circuitry includes digital processing circuitry, and wherein the zero crossing detector, the communication circuit, and the control circuit are all connected to the digital processing circuitry.

8. The arrangement of claim 3 further comprising an actuator wherein actuation of the actuator sends a connect signal or a disconnect signal to the control circuit.

9. The arrangement of claim 1 further comprising a meter housing assembly wherein the metering circuitry, the service disconnect member, the zero crossing detector, and the control circuit are all retained within the meter housing assembly.

10. The arrangement of claim 1 wherein the control circuit is configured to individually control each of the three relays in timed succession such that the service disconnect member either couples or decouples each phase of the three-phase utility power lines from the load synchronously with an associated zero crossing of such phase.

11. The arrangement of claim 1 wherein the zero crossing detector is configured to detect the first zero crossing of the first phase of the three-phase utility power lines, and further comprising:

a second zero crossing detector configured to detect the second zero crossing of the second phase of the three-phase utility power lines; and a third zero crossing detector configured to detect a third zero crossing of a third phase of the three-phase utility power lines.

12. The arrangement of claim 1 wherein balancing the coupling or decoupling of each phase further comprises:

identifying a third zero crossing of a third phase of the three-phase utility power lines;

timing a third simultaneous disconnect of the three phases of the three-phase utility power lines, subsequent to the second simultaneous disconnect, to the third zero crossing of the third phase of the three-phase utility power lines; and balancing a quantity of disconnects of the three phases timed to zero crossings of the third phase with the quantity of disconnects of the three phases timed to zero crossings of the first phase and with the quantity of the disconnects of the three phases timed to zero crossing of the second phase.

13. A method of controlling an electrical utility meter connected to three-phase utility power lines connected to a load, the method comprising:

obtaining response time data for a service disconnect member associated with the electrical utility meter;

receiving a connect signal or a disconnect signal for the service disconnect member;

determining a first zero crossing of a first phase of the three-phase utility power lines connected to the load;

calculating a first delivery time at which to issue a first control signal configured to close or open the service disconnect member synchronously with the first zero crossing of the electrical signal, based on the response time data and first zero crossing time;

determining a second zero crossing of a second phase of the three-phase utility power lines connected to the load;

calculating a second delivery time at which to issue a second control signal configured to close or open the service disconnect member synchronously with the second zero crossing of the electrical signal, based on the response time data and the second zero crossing time;

balancing coupling or decoupling of each phase of the three-phase utility power lines synchronously with an associated zero crossing of such phase over time, wherein balancing the coupling or decoupling of each phase comprises:

delaying delivery of the first control signal until the first delivery time such that the service disconnect member simultaneously either couples or decouples three phases of the three-phase utility power lines to the load synchronously with the first zero crossing of the first phase of the three-phase utility power lines;

delaying delivery of the second control signal until the second delivery time such that the service disconnect member simultaneously either couples or decouples the three phases of the three-phase utility power lines to the load synchronously with the second zero crossing of the second phase of the three-phase utility power lines; and balancing a quantity of disconnects of the three phases timed to zero crossings of the first phase with a quantity of disconnects of the three phases timed to zero crossings of the second phase.

14. The method of claim 13 wherein calculating the first delivery time is further based on the response time data.

15. The method of claim 14 wherein the first delivery time is calculated by subtracting the response time data from the first zero crossing time.

16. The method of claim 13 wherein the service disconnect member includes at least one electromechanical relay.

17. The method of claim 16 wherein the response time data is obtained from a table in a memory and is based on current temperature data and total cycles executed by the electromechanical relay.

18. The method of claim 13 further comprising obtaining temperature data from a temperature sensor, wherein the response time data for the service disconnect member is based at least in part on the temperature data.

19. An electrical utility meter comprising:

metering circuitry configured for connection to three-phase utility power lines, the metering circuitry configured to receive an electrical signal corresponding to a line voltage on the three-phase utility power lines;

a service disconnect member configured for connection to the three-phase utility power lines; and digital processing circuitry configured to:

receive temperature data from a temperature sensor; and calculate a first delivery time of a first control signal based on the temperature data and a time of a first zero crossing;

a control circuit configured to deliver the control signal to the service disconnect member, at the delivery time, synchronously with the first zero crossing of the electrical signal corresponding to the line voltage on the three-phase utility power lines;

wherein the service disconnect member is further configured to balance coupling or decoupling of each phase of the three-phase utility power lines synchronously with an associated zero crossing of such phase over time, and wherein balancing the coupling or decoupling of each phase comprises:

timing a first simultaneous disconnect of three phases of the three-phase utility power lines to the first zero crossing of a first phase of the three-phase utility power lines;

identifying a second zero crossing of a second phase of the three-phase utility power lines;

timing a second simultaneous disconnect of the three phases of the three-phase utility power lines, subsequent to the first simultaneous disconnect, to the second zero crossing of the second phase of the three-phase utility power lines; and balancing a quantity of disconnects of the three phases timed to zero crossings of the first phase with a quantity of disconnects of the three phases timed to zero crossings of the second phase.

* * * * *